United States Patent [19]

Sinkovitz et al.

[11] 4,148,639

[45] Apr. 10, 1979

[54] WATER-INSENSITIVE ELECTROCONDUCTIVE POLYMERS

[75] Inventors: Gloria D. Sinkovitz, Bridgeville; Kenneth W. Dixon, Sewickley, both of Pa.

[73] Assignee: Calgon Corporation, Pittsburgh, Pa.

[21] Appl. No.: 872,845

[22] Filed: Jan. 27, 1978

[51] Int. Cl.[2] ..... G03G 5/04

[52] U.S. Cl. ..... 96/1.5 R; 162/168 NA; 428/913; 428/511

[58] Field of Search ..... 96/1.5; 260/78.5, 63; 162/168 NA

[56] References Cited

U.S. PATENT DOCUMENTS

| | | | |
|---|---|---|---|
| 3,486,932 | 12/1969 | Schaper | 260/78.5 X |
| 3,551,384 | 12/1970 | Zeh, Jr. | 260/63 |
| 3,617,372 | 11/1971 | McNamee, Jr. et al. | 96/1.5 |
| 3,991,256 | 11/1976 | Cornier et al. | 427/74 X |

*Primary Examiner*—John D. Welsh

*Attorney, Agent, or Firm*—Mario A. Monaco; Martin L. Katz

[57] ABSTRACT

Copolymers of a cationic electroconductive monomer and a crosslinkable monomer. These polymers are electroconductive and become water-insensitive after being applied to a substrate.

8 Claims, No Drawings

WATER-INSENSITIVE ELECTROCONDUCTIVE POLYMERS

BACKGROUND OF THE INVENTION

This invention relates to electroconductive polymers, electroconductive materials and processes for preparing electroconductive paper.

Electroconductive paper may be used for a variety of purposes. Nonimpact printing processes such as electrostatographic, electrophotographic, electrographic, "Electrofax" and other processes call for the placement of an electric charge on the paper. In electrophotography, the paper also contains a photo-responsive or photoconductive layer of material, such as a specially treated zinc oxide, which causes the charge to be dissipated in an area where light strikes it, thus leaving a pattern of the charged areas which is a reproduction of the image desired. The charged area attracts a powdered or other usually particulated image-forming material which may be fused or otherwise treated to make the image permanent. In electrography, electrostatics are used without radiation. The electrical charge is deposited only in the imaged areas. The common characteristic of all of these processes is the use of an electrically conductive base paper.

Similarly, dielectric paper has a substrate which may be paper or plastic, an electroconductive coating and a top dielectric coating which will accept and hold an electrical charge until the paper is contacted with toner.

In the present methods of preparing dielectric and other forms of electroconductive paper, the substrates are coated with an aqueous conductive coating formulation and topcoated with solvent based dielectric or photoconductive, i.e. zinc oxide, formulations. Some of the disadvantages associated with this coating method are the high cost of energy-related chemicals such as solvents, the expense of specialized coating equipment with solvent recovery systems and the slow coating speeds due to the potential fire hazards of solvent coating.

The use of an aqueous topcoat in conjunction with an aqueous conductive coating is impractical when the topcoat is applied directly on the conductive layer. Migration of the conductive species occurs during the topcoating causing a breakdown of the aqueous dielectric emulsion and/or poisoning of the dielectric topcoat.

SUMMARY OF THE INVENTION

This invention is directed to an electroconductive coating formulation which overcomes the aforementioned disadvantages of solvent based coating systems. This formulation comprises an electroconductive polymer which, although applied from an aqueous slurry, becomes water-insensitive upon drying thereby permitting the use of an aqueous based topcoat without migration of the conductive species into the dielectric topcoat.

The electroconductive polymers useful in the formulation of this invention are copolymers of cationic monomers such as methacrylamidopropyltrimethylammonium chloride, methacryloxyethyl trimethylammonium chloride, 2-hydroxy-3-methacryloxypropyl trimethylammonium chloride, methacryloxyethyl trimethylammonium methosulfate, vinylbenzyl trimethylammonium chloride and quaternized 4-vinylpyridine and crosslinkable monomers such as diacetoneacrylamide, 3-chloro-2-hydroxypropyl methacrylate, glycidyl methacrylate, N-methylolacrylamide and methyl vinyl ketone. The polymers of this invention have a molecular weight of at least 100,000 and preferably at least 500,000.

The copolymers of this invention may be prepared by conventional solution polymerization techniques, as for example those described in U.S. Pat. No. 2,923,701.

In all cases, the copolymers described above are more readily crosslinked in the presence of a catalyst. The nature of the catalyst will vary with the nature of the crosslinkable monomer in the copolymer. N-methylolacrylamide, for example, may be crosslinked with ammonia as the catalyst, while methyl vinyl ketone crosslinks more effectively with hydrazine.

The copolymers of this invention are formulated in an aqueous system which contains the polymer, a crosslinking agent, water and, if desired, a binder or a pigment. The polymers of this invention may also be physically blended with inorganic salts such as sodium nitrate, sodium sulfate and sodium chloride for certain dielectric applications. The polymers of this invention will generally be employed in amounts ranging from about 0.1 to 4.0 pounds per 3000 square feet of material to be coated. Substrates such as paper and synthetic substrates, as for example MYLAR (polyethylene glycol terephthalate), nylon and polyethylene, may be coated by the polymers of this invention. Conventional coating techniques may be used.

Dielectric resins may be used alone but they usually are mixed with pigments such as barium sulfate, zinc sulfide, calcined clay, zinc oxide and other additives to insure good runability. Suitable dielectric resins include styrene/methyl methacrylate, vinyl acetate/methyl methacrylate, vinyl acetate/crotonic acid and styrene/-butadiene copolymers.

The following examples illustrate the preparation and utility of the polymers of this invention.

EXAMPLE 1

To a 1-liter resin flask are added 378.0 grams of a 50% aqueous solution of methacrylamidopropyltrimethylammonium chloride, 21.0 grams of diacetoneacrylamide, 0.5 gram of ethylenediaminetetraacetic acid and 200 ml of distilled water. The pH is adjusted to 6.0 and the solution purged with nitrogen for 1 hour while heating to 80° C. A solution of 3.2 grams of ammonium persulfate in 10 ml of water is then added. Cooling is applied to control the initial exotherm. Later, heating is applied to maintain relux for 3 hours.

EXAMPLE 2

To a 1-liter resin flask are added 480.0 grams of a 40% solution of methacryloxyethyl trimethylammonium methosulfate, 48.0 grams of 3-chloro-2-hydroxypropyl methacrylate, 0.5 gram of ethylenediaminetetraacetic acid and 72 ml of distilled water. The pH is adjusted to 5.5 and the solution purged with nitrogen for 1 hour while heating to 90° C. A solution of 2.6 grams of ammonium persulfate in 10 ml of water is added. The solution may be cooled or heated, as necessary, to maintain reflux for 4 hours.

EXAMPLE 3

To a 1-liter resin flask are added 228.0 grams of 2-hydroxy-3-methacryloxypropyl trimethylammonium chloride, 0.5 gram of ethylenediaminetetraacetic acid and 360 ml of distilled water. The pH is adjusted to 7.0 and the solution purged with nitrogen for 1 hour while heating to 90° C. A solution of 3.0 grams of ammonium persulfate in 10 ml of water is added. After the initiator addition, 12.0 grams of glycidyl methacrylate is fed in over 3 hours at reflux. After an additional hour at reflux, the product is cooled.

EXAMPLE 4

To a 1-liter resin flask are added 450.0 grams of a 40% solution of vinylbenzyl trimethylammonium chloride, 40.0 grams of a 60% solution of N-methylolacrylamide, 0.3 gram of ethylenediaminetetraacetic acid and 110 ml of distilled water. The pH is adjusted to 7.0 and the solution purged with nitrogen for 1 hour while heating to 75° C. A solution of 2.0 grams of ammonium persulfate in 5 ml of water and a solution of 0.5 gram of sodium metabisulfite in 5 ml of water are added. After 6 hours at 80°–85° C., the solution is cooled.

EXAMPLE 5

To a 1-liter resin flask are added 126.0 grams of 4-vinylpyridine, 54.0 grams of N-(iso-butoxymethyl) acrylamide, 0.2 gram of ethylenediaminetetraacetic acid and 400 ml of distilled water. The pH is adjusted to 3.5 with concentrated hydrochloric acid. The solution is purged with nitrogen for 1 hour while heating to 60° C. Solutions of 2.5 grams of ammonium persulfate in 8 ml of water and 1.0 gram of sodium metabisulfite in 8 ml of water are added. The temperature is maintained at 60° C. for 6 hours. The solution is cooled and 67.0 grams of 50% sodium hydroxide solution and 105.0 grams of dimethylsulfate are added over 1.5 hours at 35°–45° C. The solution is stirred at 45° for an additional hour and then cooled.

EXAMPLE 6

To a 1-liter resin flask are added 342.0 grams of a 50% solution of methacrylamidopropyltrimethylammonium chloride, 0.3 gram of ethylenediaminetetraacetic acid and 250 ml of distilled water. The pH is adjusted to 7.0 and the solution purged for 1 hour with nitrogen while heating to 100° C. A solution of 2.7 grams of ammonium persulfate in 10 ml of water is added. Methyl vinyl ketone, 9.0 grams, is fed into the solution over 4 hours at reflux. After an additional hour at reflux, the product is cooled.

EXAMPLE 7

A typical conductive polymer formulation would contain 25% conductive polymer, 20% binder, 50% pigment and 5% of a suitable crosslinking agent. The pigment is generally prepared in a 65% active solids slurry. The required amount of crosslinking agent is solubilized in a portion of the dilution water. The final coating preparation is prepared by adding, in the following order: clay (134.6 grams), electroconductive polymer (109.3 grams of 40% solution) prepared in accordance with the procedure of Example 4, dilution water (120 grams), binder (67.3 grams of 52% active terpolymer of ethylene, vinyl acetate and N-methylolacrylamide) and crosslinking agent (8.8 grams of $NH_4Cl$ in 60 grams of water). The pigmented formulation is adjusted to pH 8 with $NH_4OH$. The coating should be smooth and free of grit formation.

EXAMPLE 8

The conductive polymer prepared in accordance with the procedure of Example 1 may be formulated in the following manner. A 400 ml plastic beaker is charged with 59.2 grams of clay (65% solids) slurry. Under constant stirring, 58.3 grams of electroconductive polymer (40% active solids) is added, followed by 26.9 grams of binder (52% active solids terpolymer of ethylene, vinyl acetate and N-methylolacrylamide), 52.6 grams of water and 1.2 grams of cross-linking agent (85% active solids hydrazine hydrate). The formulation should be smooth and grit-free. The pH of the coating should be between 8 and 9.

We claim:

1. An electroconductive paper which contains a layer of a coating composition which contains a water-insensitive copolymer of a cationic monomer selected from the group consisting of methacrylamidopropyltrimethylammonium chloride, methacryloxyethyl trimethylammonium chloride, methacryloxyethyl trimethylammonium methosulfate, 2-hydroxy-3-methacryloxypropyl trimethylammonium chloride, quaternized 4-vinylpyridine and a crosslinable comonomer.

2. An electroconductive paper as in claim 1 wherein the copolymer is present in a concentration of at least 0.1 pound per 3000 square feet of paper.

3. An electroconductive paper as in claim 1 wherein the polymer containing layer also contains a binder.

4. An electroconductive paper as in claim 3 wherein the polymer containing layer also contains a pigment.

5. An electroconductive paper as in claim 1 wherein the polymer is physically blended with an inorganic salt.

6. An electroconductive paper as in claim 1 wherein the paper also contains a dielectric layer.

7. An electroconductive paper as in claim 1 wherein the paper also contains a photoconductive layer.

8. A method of making electroconductive paper which comprises coating said paper with at least 0.1 pound per 3000 square feet of a water-insensitive copolymer of a catonic monomer selected from the group consisting of methacrylamidopropyltrimethylammonium chloride, methacryloxyethyl trimethylammonium chloride, methacryloxyethyl trimethylammonium methosulfate, 2-hydroxy-3-methacryloxypropyl trimethylammonium chloride, vinylbenzyl trimethylammonium chloride, quaternized 4-vinylpyridine and a crosslinkable comonomer.

* * * * *

UNITED STATES PATENT AND TRADEMARK OFFICE

CERTIFICATE OF CORRECTION

PATENT NO. : 4,148,639

DATED : April 10, 1979

INVENTOR(S) : Gloria D. Sinkovitz and Kenneth W. Dixon

It is certified that error appears in the above-identified patent and that said Letters Patent are hereby corrected as shown below:

Please insert on Title Page under Related U.S. Application Data and at the beginning of the Specification:

"This is a continuation-in-part of U.S. Serial No. 864,412, filed December 27, 1977, now abandoned."

Signed and Sealed this

*Fourteenth* Day of *August 1979*

[SEAL]

*Attest:*

*Attesting Officer*

LUTRELLE F. PARKER

*Acting Commissioner of Patents and Trademarks*